United States Patent [19]

Okamoto et al.

[11] 4,387,620

[45] Jun. 14, 1983

[54] AUTOMATIC PERFORMING APPARATUS FOR MUSICAL PERFORMANCE DATA WITH MAIN ROUTINE DATA AND SUBROUTINE DATA

[75] Inventors: Eisaku Okamoto; Kotaro Mizuno, both of Hamamatsu, Japan

[73] Assignee: Nippon Gakki Seizo Kabushiki Kaisha, Shizuoka, Japan

[21] Appl. No.: 320,933

[22] Filed: Nov. 13, 1981

[30] Foreign Application Priority Data

Nov. 19, 1980 [JP] Japan ..... 55-162024

[51] Int. Cl.[3] ..... G10H 1/42; G10H 3/06; G10H 7/00

[52] U.S. Cl. ..... 84/1.03; 84/1.18; 84/DIG. 12

[58] Field of Search ..... 84/1.03, 1.18, DIG. 12

[56] References Cited

U.S. PATENT DOCUMENTS 3,958,483 5/1976 Borrevik et al. ..... 84/1.03
4,186,639 2/1980 Robinson et al. ..... 84/1.03
4,299,154 11/1981 Dietrich et al. ..... 84/1,03
4,344,345 8/1982 Sano ..... 84/1.03

*Primary Examiner*—S. J. Witkowski
*Attorney, Agent, or Firm*—Oblon, Fisher, Spivak, McClelland & Maier

[57] ABSTRACT

In an automatic performing apparatus in which musical performance data are sequentially read out of a memory at time intervals corresponding to the durations of musical notes to thereby execute an automatic performance, a repeatedly played part is stored as subroutine data in the memory, together with main routine data, thereby to store much data in the memory having a limited capacity. The main routine data contains instruction data for calling the subroutine data and the subroutine data contains instruction data for the return to the main routine data. In response to a signal from a subroutine control circuit, the count of an address counter for designating an address in the memory jumps to an address of the subroutine data when the subroutine calling instruction data is read out, and jumps back to an address of the main routine data when the instruction data for the return to the main routine is read out.

5 Claims, 8 Drawing Figures

| | | |
|---|---|---|
| FIG. 3A | FIG. 3B | FIG. 3C |

AUTOMATIC PERFORMING APPARATUS FOR MUSICAL PERFORMANCE DATA WITH MAIN ROUTINE DATA AND SUBROUTINE DATA

BACKGROUND OF THE INVENTION

This invention relates to an electronic musical instrument and, more particularly, to an automatic performing apparatus of an electronic musical instrument which reads out musical performance information stored on an appropriate recording medium and generates musical tone signals according to the musical performance information.

An automatic performing apparatus of this type is provided with a memory to store musical performance information which has been read out of the recording medium. The memory successively stores musical note data including pitch data and duration data for musical notes in accordance with progression of a music to be played. Musical note data are successively read out of the memory at time intervals corresponding to note durations, and then musical tone signals having pitches represented by pitch data read out of the memory are produced. Such an automatic performing apparatus may be provided with an auto rhythm playing device, and the note duration is measured by tempo clock pulses used for rhythm generation. An example of such apparatus is disclosed in a copending United States Patent Application Ser. No. 217,896 filed Dec. 18, 1980, now U.S. Pat. No. 4,364,299, and assigned to the same assignee as this application.

With such an automatic performing apparatus, if the pitch data and duration data of the respective musical notes are stored in the memory according to the progression of a music, then the storage capacity of the memory must be inevitably increased as the length of the music increases.

There is a case that, in performing a music, a pitch pattern as a combination of some pitches and/or a duration pattern as a combination of some durations appear repeatedly. If the information of repeatedly appearing patterns are stored, as subroutine data, into a data memory, the capacity of the memory can considerably be saved.

SUMMARY OF THE INVENTION

Accordingly, an object of the present invention is to provide an automatic performing apparatus which may reduce the storage capacities of an external recording medium such as a magnetic tape and a bar-coded printing for storing musical performance data and an internal memory for storing the musical performance data read out of the external recording medium.

The above object can be attained by the provision of a first memory for storing pitch data and a second memory for storing duration data, and storing performance data, which relates to a part or parts repeatedly played during the course of playing a music to be played, as subroutine data in the first and/or second memory, together with main routine data.

When a repeatedly played part exhibits a common pattern for both pitch and duration, the pitch data and the duration data, which relate to the part, are stored as the subroutine data in the first and second memories. When the repeatedly played part exhibits a common pattern for only the pitch, the pitch subroutine data relating to the part is stored in the first memory. Further, when the repeatedly performed part exhibits a common pattern for only the duration, the duration subroutine data relating to this part is stored in the second memory.

DETAILED DESCRIPTION OF THE PREFERRED EMBODIMENT

An automatic performing apparatus of the present invention is provided with a first data memory for storing pitch data containing pitch subroutine data and a second data memory for storing duration data containing duration subroutine data. In an embodiment of the present invention to follow, the pitch data is formed of 8 bits, and the duration data is formed of 5 bits. Further, it is assumed that the number of patterns repeated is four for each of pitch and duration.

Figure 1:
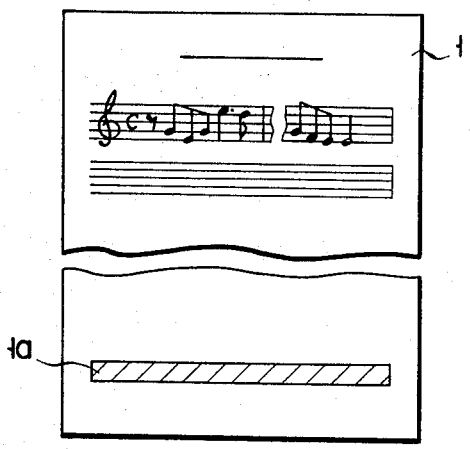
FIG. 1 illustrates an example of a music sheet with a recording medium having musical performance data stored thereon.
Figure 2A:
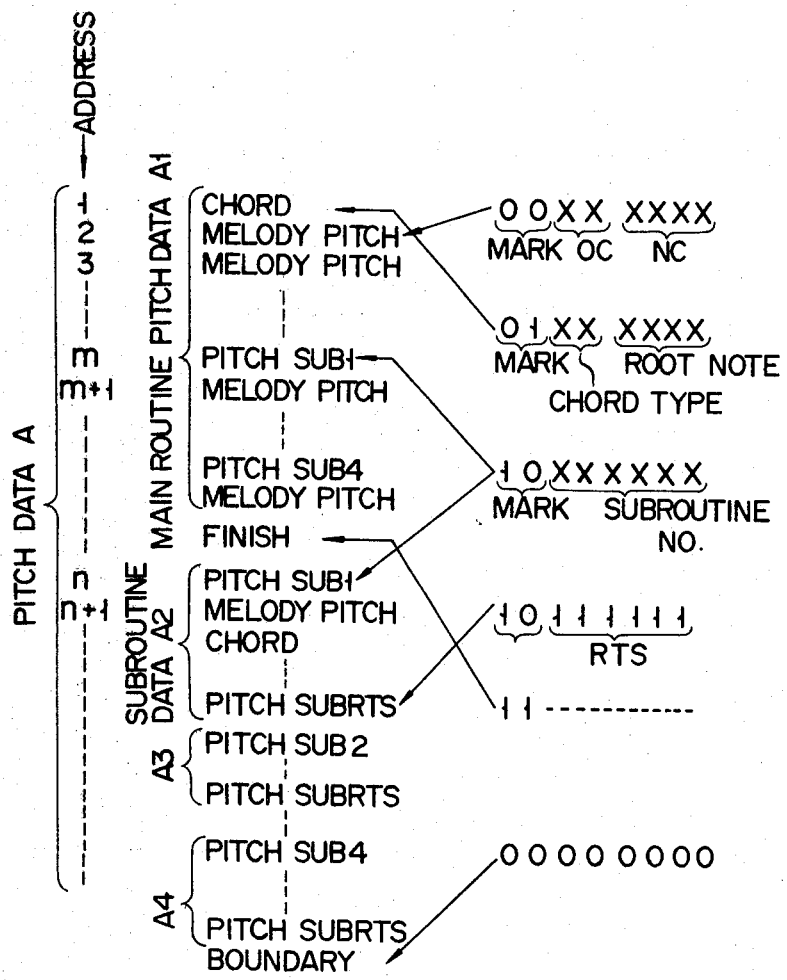
FIGS. 2A and 2B show an example of formats of the pitch performance data and duration performance data, respectively.
Figure 2B:
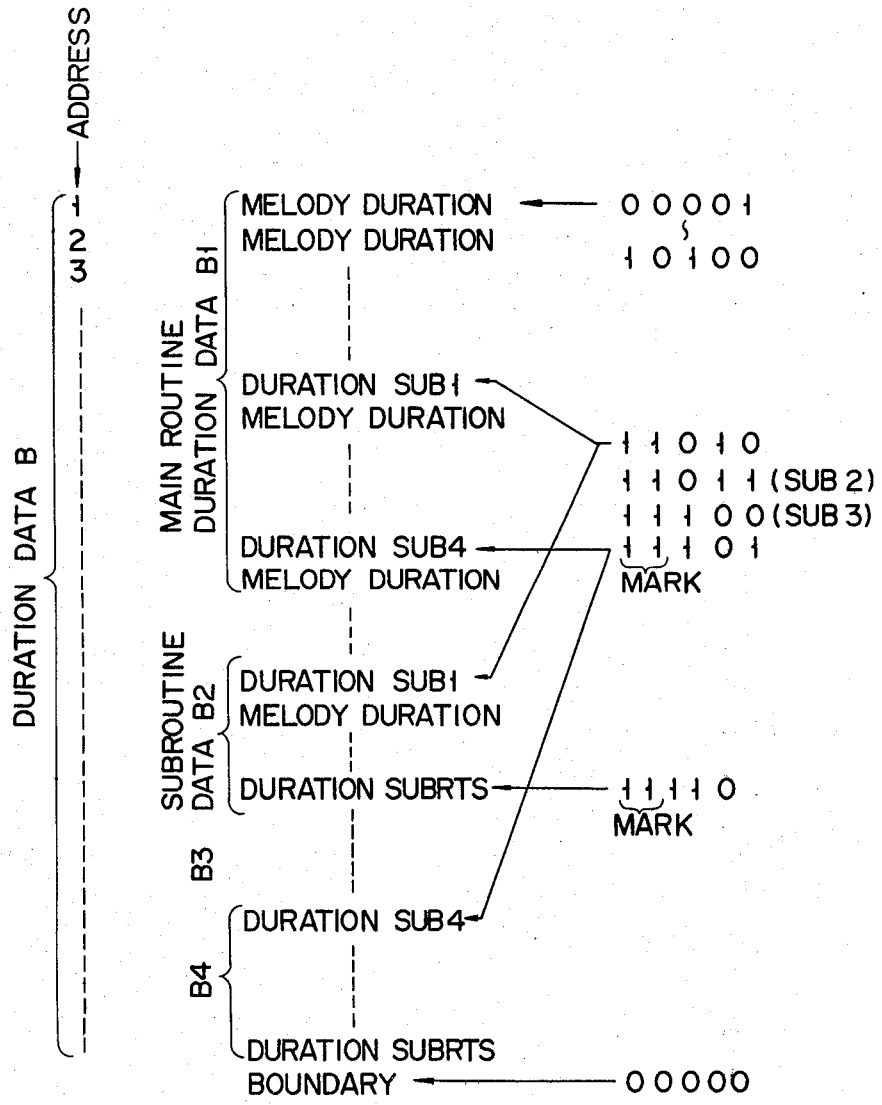

As shown in FIG. 1, a storage portion 1*a* such as a magnetic tape or the like is provided at a lower portion of a music sheet 1. The musical note data representing score printed on the sheet is stored in a digital fashion on the storage portion 1*a*. The musical note data can be stored in the form of clock pulses phase-encoded by performance data. As shown in FIGS. 2A and 2B, the musical note data includes pitch data A stored in a pitch data memory (RAM 1) as will be described later and a duration data B stored in a duration data memory (RAM 2) to also be described later.

The pitch data A is comprised of pitch main routine data A1 having chord data, melody pitch data and pitch subroutine calling data for instructing a jump to pitch subroutine data SUB 1, SUB 2, SUB 3, and SUB 4 and pitch subroutine data A2, A3 and A4 including chord data and melody pitch data. At the heads of pitch subroutine data A2, A3 and A4, there are diposed PITCH SUB 1 to SUB 4 indicating the beginning of subroutines, respectively, while at the ends of pitch subroutine data instruction data PITCH SUB RTS are disposed for instructing the return from the pitch subroutine data to the pitch main routine data. FINISH data is placed immediately after the main pitch data A1.

The chord data, melody pitch data and subroutine calling data are each formed of eight bits. The first two bits are used for a mark indicating a type of the data, and the remaining six bits represent the content of each data. For example, the chord data has a chord identifying mark "01", and the two bits following the chord identifying mark are used for disignating a chord type such as a major chord or a minor chord. The remaining four bits are used for designating a root note of the chord. In the case of the melody pitch data, the first two bits are "00" to identify a melody tone pitch. The following two bits designate an octave, and the remaining four bits designate one of the twelve notes of one octave. All the data concerning subroutine included in the pitch main routine data A1 and the pitch subroutine data A2, A3 and A4 have each an identifying mark "10". The remaining six bits of the data SUB 1 in the main data A1 and the data SUB 1 placed at the head of the subroutine data A2, have the same content representing a subroutine number (No.). This is true for the data SUB 2, SUB 3 and SUB 4. The data SUB RTS placed at the end of the subroutine data has a identifying mark "10" and a return instruction to the pitch main routine data A1 of all bits of 1's.

As shown in FIG. 2B, the duration data B is comprised of duration main routine data B1 inculding melody tone duration data and duration subroutine calling data SUB 1 to SUB 4 and duration subroutine data B2 to B4 including melody tone duration data. DURATION SUB 1 to SUB 4 indicating the beginning of the subroutine data are placed at the heads of the duration subroutine data B2 to B4, respectively. And return instruction DURATION SUB RTS to the duration main routine data B1 are placed at the ends of the duration subroutine data B2 to B4. All the data concerning the duration subroutine have the same identifying mark of "11". The data SUB 1 in the main duration data B1 and the data SUB 1 in the duration subroutine data B2 are identical to each other with respect to three bits other than two bits for the identifying mark, which indicate a duration subroutine number (No.). As described above, the melody tone duration data is comprised of five bits and indicates a note duration in the form of notes like a quarter note without break, a quarter note with break, an eighth note without break or an eighth note with break. This is done for the purpose of an effective utilization of a storage capacity of the memory portion 1*a* of the music sheet 1.

Boundary codes with all bits of 0's are placed at the ends of the pitch data A and the duration data B.

Figures 3, 3A:
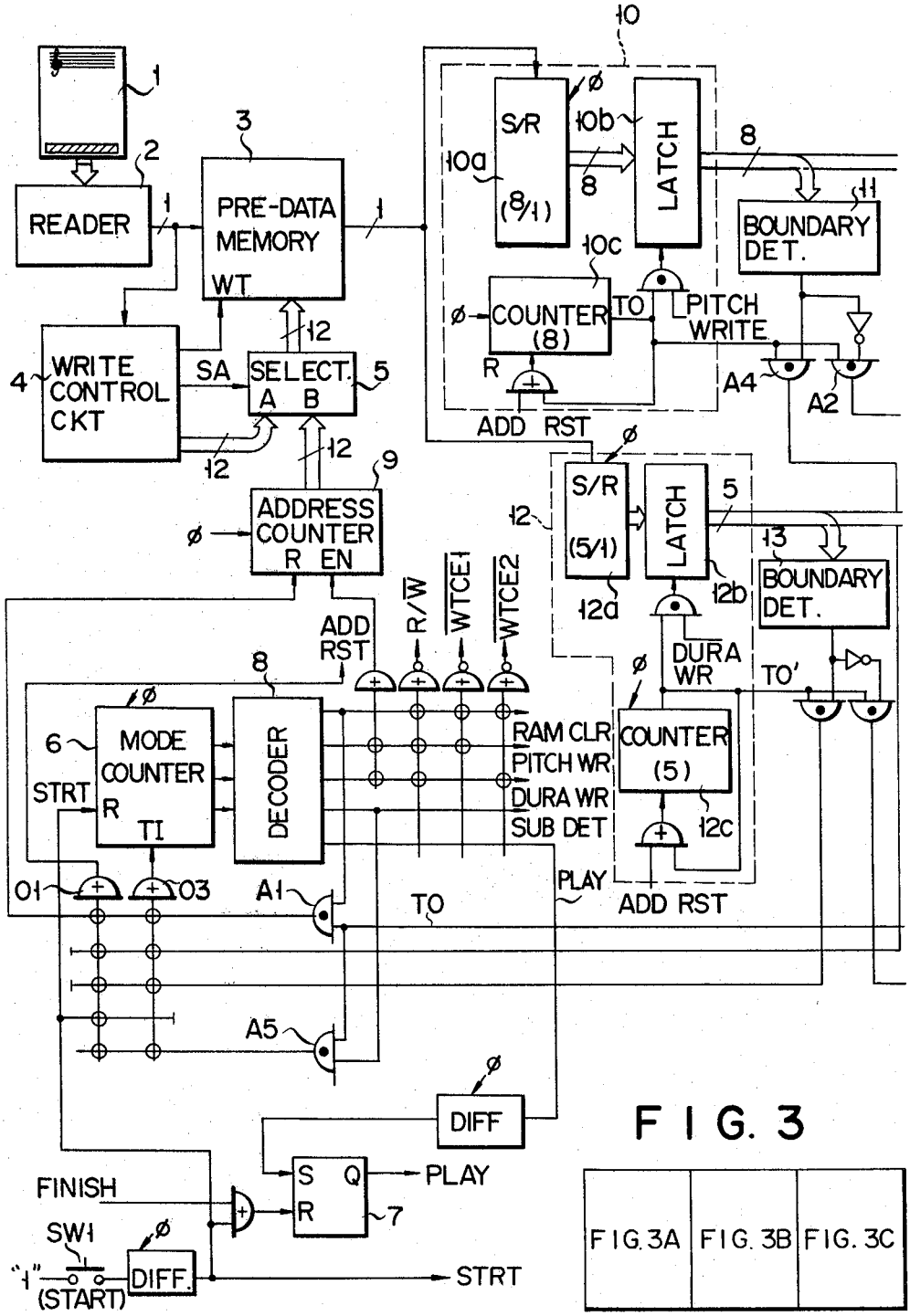
FIGS. 3A, 3B and 3C, taken together as in FIG. 3, show an embodiment of an automatic performing apparatus of the present invention.
Figure 3B:
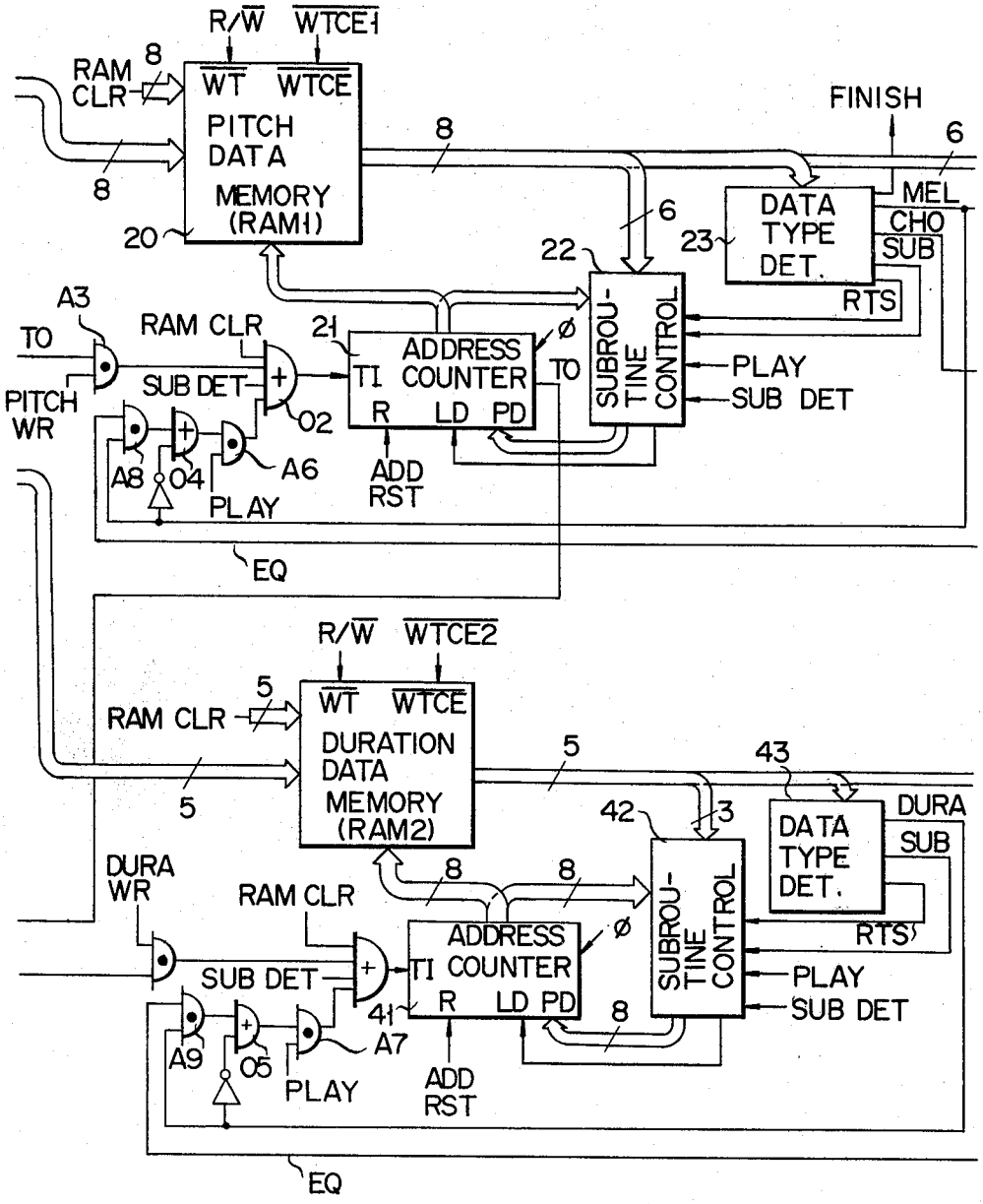
Figure 3C:
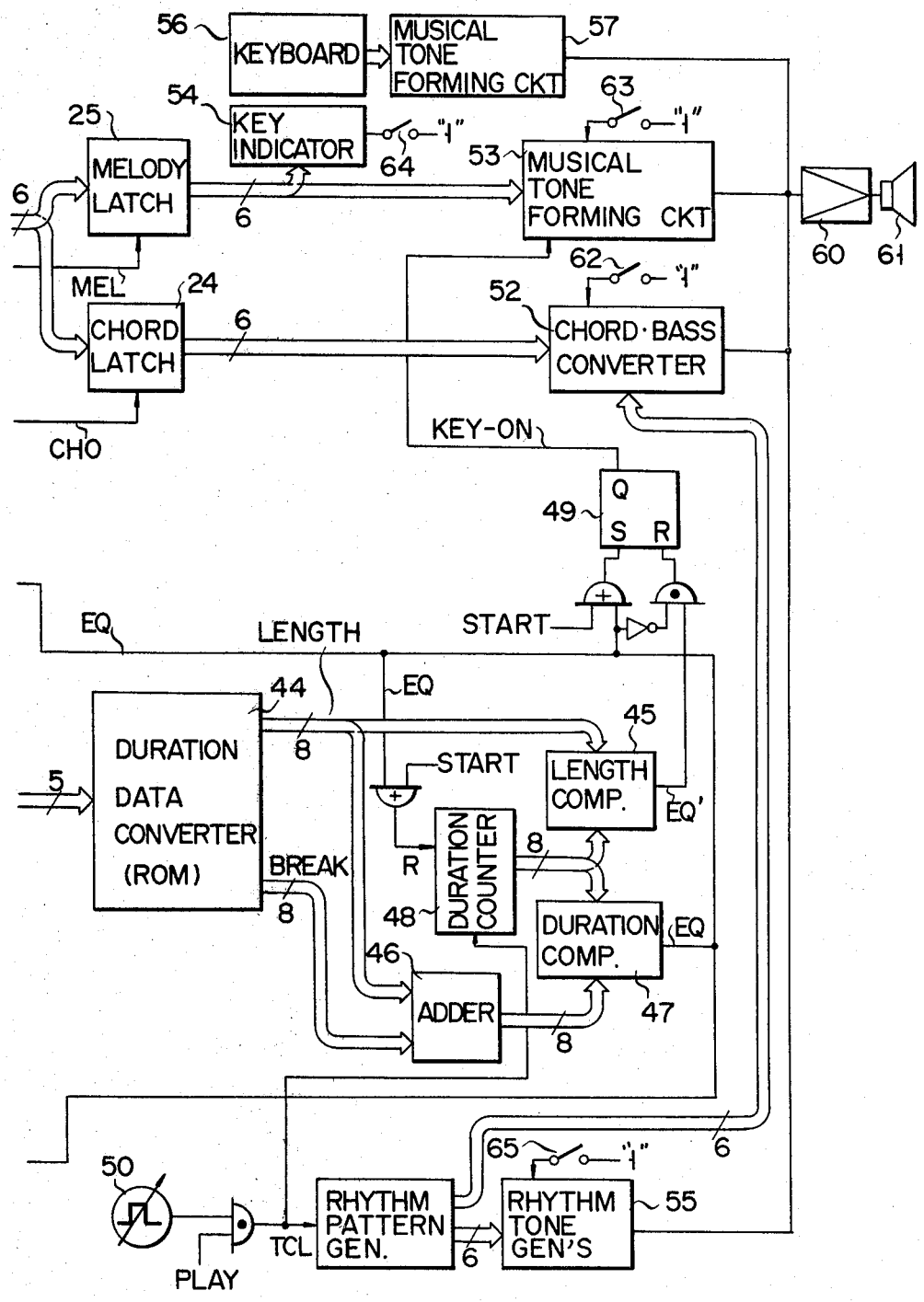

Musical performance data recorded on the memory portion 1*a* of the music sheet 1 as described above is processed in the following way for executing an automatic performance. The automatic performing apparatus according to an embodiment of the present invention will be described referring to FIGS. 3A, 3B and 3C, taken together as in FIG. 3.

READ MODE OF MUSICAL PERFORMANCE DATA

The music sheet 1 is first inserted in a slit provided on a readout device 2. The musical performance data is read out bit by bit, by a magnetic head, by shifting the sheet by hand along the slit. Alternatively, the musical performance data may be recorded on the music sheet 1 by a bar-coded printing or in other manner that it is read out by an optical readout device.

The musical performance data read out is serially stored in a pre-data memory 3. The musical performance data is also supplied to a write control circuit 4. The control circuit 4 instructs the data write to the memory 3 during the readout of the musical performance data, and causes a select circuit 5 to supply an address signal applied to address input terminals A to the memory 3. The write control circuit 4 is provided with a counter for counting clock pulses contained in the musical performance data, and forms an address signal to be applied to the address input terminals A of th select circuit 5. Thus, the musical performance data (pitch data and duration data) are sequentially stored in memory locations of pre-data memory 3 which are designated by the address signals formed by the write control circuit 4.

CLEAR MODE OF PITCH DATA MEMORY

When a start switch SW1 connected to a logical 1 voltage source is operated, differentiating circuit driven by system clock pulses Ø (e.g. 1 MHz) forms a start signal STRT. The start signal STRT resets a mode counter 6 for counting the system clock pulses Ø and a performance flip-flop 7. The start signal STRT is derived from an OR gate $O_1$ as an address reset signal ADR RST which resets an address counter 21 of a pitch data memory (RAM 1) 20 and an address counter 41 of a duration data memory (RAM 2) 40.

When the mode counter 6 is reset by the start signal STRT, the "0" output of a decoder 8 goes high to form a RAM clear signal RAM CLR. The RAM clear signal RAM CLR is supplied to input terminals of the pitch data memory 20 and to a terminal TI of the address counter 21 through an OR gate $O_2$. The address counter 21 is enabled, when its terminal TI is at logic 1 level, to count the system clock pulses Ø. While the address counter 21 counts the clocks Ø, the RAM clear signal RAM CLR of logic 1 is applied to the memory 20. As a result, the memory 20 is cleared to an all 1 state. The duration data memory 40 is cleared to an all 1 state in a similar way. When the count of the address counter 21 reaches a maximum address number of the memory 20, the address counter 21 generates a count finish signal TO. The count finish signal TO is applied to the terminal TI of the mode counter 6 via an AND gate A1 enabled by "0" output of the decoder 8 and an OR gate $O_3$. As a result, the mode counter 6 counts one shot of the clocks Ø so that the "1" output of the decoder 8 goes high to generate a PITCH WRITE signal. Consequently, the operation of the apparatus changes from the RAM CLEAR mode to the PITCH WIRTE mode.

In the RAM clear mode, signals R/W, $\overline{\text{WTCE1}}$ and $\overline{\text{WTCE2}}$ formed by logic gates connectd to the outputs of the decoder 8 are all low in level. Therefore, the pitch data memory 20 and the duration data memory 40 are both in a write enable state.

WRITE MODE OF PITCH DATA

As described above, the count finish signal TO formed by the address counter 21 resets the address counter 9 through the AND gate A1. At the same time, an address reset signal ADR RST is taken from the OR gate $O_1$ to reset the address counter 21.

When the "1" output of the decoder 8 goes high, the address counter 9 is enabled to count the clocks Ø. The address counter 9 counts the clocks Ø to form an address signal to be supplied to the pre-data memory 3 via the address select circuit 5. As a result, the musical performance data is read out bit by bit from the memory 3. The serial musical performance data is converted into 8-bit parallel data representing the pitch of each note by a serial-to-parallel (S/P) converting circuit 10 including a shift register 10*a* of 8 binary stages, a latch circuit 10*b* and a counter 10*c* which counts the clocks Ø and has the maximum count of 8. The 8-bit parallel data is supplied to the pitch data memory 20.

As described above, the address counter 21 is reset at the beginning of the pitch data write mode. As a result, the first 8-bit parallel data is stored in a start address of the pitch data memory 20. In the S/P converting circuit 10, the counter 10*c* generates a count finish signal TO every time it counts eight shots of clocks Ø, and the counter is reset, in response to the signal TO, to an initial state. In response to the count finish signal TO, the latch circuit 10b latches the data of the shift register 10a. The count finish signal TO is supplied to the terminal TI of the address counter 21 through an AND gate A2 enabled by the output of a boundary detecting circuit 11 which remains low at this time, an AND gate A3 enabled by the PITCH WRITE signal and an OR gate $O_2$. Therefore, the address counter 21 is enabled to count one shot of clocks Ø every time the counter 10c generates the count finish signal TO. In this way, every time the count finish signal TO is generated, in other words, every time the parellel data of the shift register 10a is latched by the latch circuit 10b, the address counter 21 is incremented by one. As a result, the 8-bit parallel data for the respective melody notes are sequentially stored in memory locations of the pitch data memory 20 designated by the address counter 21.

In the pitch write mode, since the control signals R/$\overline{W}$ and $\overline{WTCE1}$ are 0, and the control signal $\overline{WTCE2}$ is 1, the pitch data memory 20 is in a write enable state, while the duration data memory 40 is in a write disable state. In this mode, a latch circuit 12b of another S/P converting circuit 12 supplied with data which is the same as data supplied to S/P converting circuit 10 is also disabled.

As shown in FIG. 2A, when a boundary code following the pitch data A is detected by the boundary code detecting circuit 11 (coninciding with a timing that the counter 10c generates the output signal TO), an AND gate A4 generates an output signal of logic 1 which enables the mode counter 6 and resets the address counters 21 and 41. When the mode counter 6 is enabled, the DURATION WRITE signal or "2" output of the decoder 8 goes high. As a result, the operation mode of the automatic performing apparatus changes from the pitch write mode to the duration write mode.

DURATION WRITE MODE

In the duration write mode, the signals R/$\overline{W}$ and $\overline{WTCE2}$ are 0, while the signal $\overline{WTCE1}$ is 1. Therefore, the pitch data memory 20 is in a write disable state, while the duration data memory 40 is in a write disable state. The duration data read out of the pre-data memory 3 is converted into a 5-bit parallel data by the S/P converting circuit 12 in the same way as the pitch data. The S/P converting circuit 12 includes a shift register 12a, latch circuit 12b and counter 12c which counts the system clocks Ø and has its maximum count of 5. The 5-bit duration data is stored in the duration data memory 40 in the same manner as the pitch data is stored in the pitch data memory 20. When the boundary code following the duration data B is detected by a boundary code detecting circuit 13, the mode counter 6 is enabled and the counters 10c, 12c, 21 and 41 are reset as in the case of the pitch data. When the mode counter 6 is enabled, a SUB DET signal or "3" output of the decoder 8 goes high. Then, the operation of the automatic performing apparatus changes from the duration write mode to the subroutine detecting mode.

SUBROUTINE DETECTING MODE

In this mode, the signals R/$\overline{W}$, $\overline{WTCE1}$ and $\overline{WTCE2}$ becomes 1, and thus, both the pitch data memory 20 and the duration data memory 40 are set to a read enable state. The terminals TI of the address counters 21 and 41 go to logic 1 level, and thus the address counters 21 and 41 are enabled. Consequently, the pitch data A and the duration data B are read out of the pitch data memory 20 and the duration data memory 40, respectively.

The purpose of the subroutine detection is to detect and store an address of each subroutine data in the musical performance data read out of the pitch data memory 20 and the duration data memory and to jump the count of the address counter to an address of the corresponding subroutine data when the subroutine calling instruction is read out of the memory in the musical performance mode to be described later.

Figure 4:
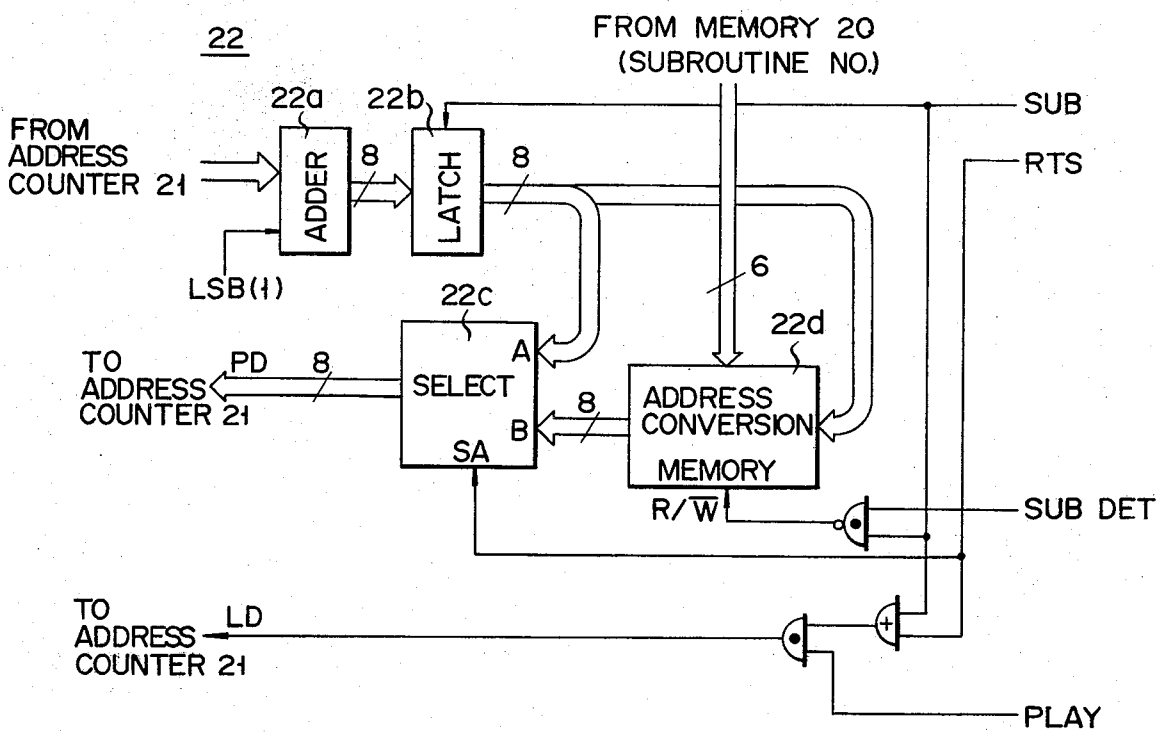
FIG. 4 shows a practical arrangement of a subroutine control circuit.

In the subroutine detecting mode, subroutine control circuits 22 and 42 operate. The subroutine control circuit 22 will be described referring to FIG. 4. The subroutine control circuit 22 is comprised of an adder circuit 22a, a latch circuit 22b, a select circuit 22c and an address data converting memory (RAM) 22d. The adder circuit 22a adds LSB (least significant bit) of "1" to an address signal from the address counter 21. The latch circuit 22b latches an output signal of the adder circuit 22a in response to a subroutine mark detect signal SUB derived from a data type descrimination circuit 23. In the subroutine detecting mode, the address converting memory 22d is in a write enable state since its R/$\overline{W}$ terminal is at logic 0 level. The address converting memory 22d receives 6-bit data (in the case of the main pitch data A1, a subroutine number represented by the subroutine calling instruction) read out of the memory 20 as an address signal, and stores the address signal latched by the latch circuit 22b in a memory location designated by the 6-bit address signal from the memory 20. The select circuit 22c selectively applies either the address signal applied its input terminals A from the latch circuit 22b or the address signal applied its input terminals B from the address converting memory 22d to the address counter 21 as preset data PD depending on a level of a select signal (a detect signal RTS from the data type discrimination circuit 23 for a return instruction to the main pitch data) applied to a terminal SA. The select circuit 22c selects the address signal applied to the input terminals B when the terminal SA is at a logic 0 level. The address signal selected by the selector 22c is preset to the address counter 21 at a time when either the subroutine identifying mark or the return instruction to the main pitch data is detected by the data type discriminating circuit 23 in the PLAY mode as described later.

Referring to FIG. 2A, the operation of the subroutine control circuit 22 will be described. In the subroutine detecting mode, when the data PITCH SUB 1 is read out of an address n of the pitch data memory 20, an output signal (n+1) of the adder circuit 22a is latched in the latch circuit 22b. The data latched in the latch circuit 22b is stored in that location in the memory 22d which is designated by the 6-bit data indicating the subroutine number of PITCH SUB 1 from the pitch data memory 20. The similar operation is performed when the other data PITCH SUB 2 to PITCH SUB 4 are ared out. In case that the dat PITCH SUB 1 appear a plurality of times in the main pitch data A1, the content of the location, which is designated by the subroutine number indicated by PITCH SUB 1, of the address converting memory 22d is updated every time the data PITCH SUB 1 is read out.

When the data PITCH SUB 1 of the subroutine data A2 at the n-th address is read out, the data at the location corresponding to PITCH SUB 1 of the address converting memory 22d becomes (n+1) finally. This is true for other data PITCH SUB 2 to PITCH SUB 4. The data stored in the corresponding locations of the address converting memory 22d will finally become the address numbers of the first pitch data of the subroutine data A3 to A5.

In the duration subroutine, like the pitch subroutine, addresses of the duration subroutine data are detected and stored by subroutine control circuit 42 and data type discrimination circuit 43.

As described above, in the subroutine detecting mode, the performance data are sequentially read out of the memories 20 and 40, and the address counter 21 finally generates a count finish signal TO. The count finish signal TO is supplied to OR gates $O_1$ and $O_3$ through an AND gate A5 enabled during the subroutine detecting mode. Accordingly, the mode counter 6 is enabled and the address counters 21 and 41 are reset. The mode counter 6 counts clocks Ø, so that the "4" output of the decoder 8 goes high. As a result, the performance flip-flop 7 is set, and the operation mode of the apparatus is changed from the subroutine detecting mode to a performing mode.

AUTOMATIC PERFORMANCE MODE

At the beginning of an automatic performance mode, a melody mark detect signal MEL from the data type discrimination circuit 23 and a duration mark detect signal DURA from the data type discrimination circuit 43 are both "0". Accordingly, output signals of the AND gates A6 and A7 to which a PLAY signal is supplied are high, so that the address counters 21 and 41 are both enabled. As shown in FIG. 2A, chord data is first read out of the pitch data memory 20. A chord detect signal CHO of the data type discrimination circuit 23 becomes high, to thereby latch the chord data in chord latch circuit 24. Then, melody pitch data is read out of the memory 20, and is latched in the melody latch circuit 25 by the melody detect signal MEL from the data type detecting circuit 23. At this time, a duration coincidence signal EQ from a duration comparator 47 to be described later is "0", so that the output signals of an AND gate A8 and an OR gate $O_4$ are both "0". Accordingly, the AND gate A6 is disabled. As a result, the address counter 21 is disabled, to thereby stop the readout of data from the pitch data memory 20 until the duration coincidence signal EQ becomes "1".

Melody duration data is read out from the duration data memory 40, and supplied to the data type discrimination circuit 43 and the duration data converting circuit 44. Since the duration mark detect signal DUR of the data type discrimination circuit 43 becomes "1" and the duration coincidence signal EQ is "0", the output signals of AND gate A9 and OR gate $O_5$ becomes "0". For this reason, the AND gate A7 is disabled. As a result, the address counter 41 is disabled, to thereby stop the readout of data from the duration data memory 40 until the duration coincidence signal EQ becomes "1".

As mentioned above, the duration data read out of the duration data memory 40 represents a note duration in terms of a quarter note without break, a quarter note with break or the like. The duration data converting circuit 44 is comprised of a read only memory (ROM), and receives the duration data as an address signal to read out 8-bit sound length data representing a period that a melody tone is sounded, and 8-bit break length data indicating a period the the melody tone is to be interrupted before the next melody tone is generated. For example, in the case of the quarter note without break, the break length data exhibits 0. The sound length data is supplied to the length comparator 45 and the adder 46. The break length data is supplied to the adder 46 where it is added to the length data. An output of adder 46 represents a length of time from the beginning of generation of a melody tone to the beginning of generation of a next melody tone, that is, the duration of melody tone.

In the play mode, tempo clocks TCL from a tempo oscillator 50 are applied to an automatic rhythm performing system and to a duration counter 48. During the play mode, the duration counter 48 is reset every time a duration coincidence signal EQ is produced. A count signal of the duration counter 48 is supplied to the length comparator 45 and the duration comparator 47.

When the count of duration counter 48 is coincident with LENGTH data, the comparator 45 forms a coincidence signal EQ'. At this time, when the coincidence signal EQ of the duration comparator 47 is "0", KEY-ON flip-flop 49 which has been set by the STRT signal is reset by the coincidence signal EQ'. Thereafter, the duration comparator 47 produces a coincidence signal EQ to set the KEY-ON flip-flop 49. Upon generation of the duration coincidence signal EQ, the address counters 21 and 41 are enabled, as mentioned above, so that the next data are read out of memories 20 and 40.

When the break length is 0, the coincidence signals EQ' and EQ are simultaneously produced. For this reason, the KEY-ON flip-flop 49 is designed to be of a set dominant type.

When the count of the address counter 21 reaches m, the PITCH SUB1 is read out of the pitch data memory 20. (m+1) is latched in the latch circuit **22*b* shown in FIG. 4, as described above. In the performance mode, the address converting memory 22*d* is in a read enable state, so that (m+1) is not all allowed to be written into the memory 22*d*. In this case, however, (n+1) stored in the subroutine detecting mode is read out of the memory location of the address converting memory 22 specified by the PITCH SUB1, and then supplied as preset data to the address counter 21 through the select circuit 22*c*. In the PLAY mode, when the subroutine mark is detected by the data type discriminating circuit 23, a load instruction signal LD is applied to the address counter 21 to load the preset data thereinto. Namely, the count of address counter 21 jumps from m to (n+1). Thereafter, the address counter 21 counts the clocks Ø. Therefore, the subroutine data A2 is read out from the addresses starting with the address (n+1) of pitch data memory 20. When the final data PITCH SUBRTS in the substroutine data A2 is read out, the output signal RTS of the data type discriminating circuit 23 becomes "1", causing the selector 22 to transfer the output signal (m+1) of the latch circuit 22*b* applied to the terminals A to the address counter 21. The address counter 21** is loaded with (m+1) by the load instruction signal LD.

Thus, the address of the pitch data memory 20 specified by the address counter 21 jumps back to (m+1) of the main routine and the readout operation of the main pitch data A1 is reinitiated. In this way, the data readout operation proceeds and after the final pitch data of the main routine data A1 is read out, the FINISH data is read out. When the FINISH data is detected by the data type discriminating circuit 23, the performing flip-flop 7 is reset, so that the address counter 21 is disabled to terminate the data readout from the pitch data memory 20.

The code data latched in the latch circuit 24 is supplied to the chord/bass converter 52, to thereby form chord and bass tone signals. The chord/bass converter 52 is controlled by a rhythm pattern signal formed by a rhythm pattern generator 51 to provide rhythmic chord and bass performances. The melody tone data latched in the latch circuit 25 is supplied to musical tone forming circuit 53 to form a musical tone signal with the pitch represented by the pitch data. The musical tone forming circuit 53 is enabled or disabled by the KEY-ON flip-flop 52. An enable period and a disable period of the musical tone forming circuit 53 are determined by the duration data. The melody tone signal from the musical tone forming circuit 53, the chord and bass tone signals from the chord/bass converter 52, and the rhythm tone signal from the rhythm tone generators 55 are commonly applied to a sound system including an amplifier 60 and a loudspeaker 61 to be sounded.

The automatic performing apparatus of the present invention may be provided with a manual performing means. Reference numerals 56 and 57 designate a keyboard and a musical tone forming circuit for forming a musical tone signal by a key code signal produced by key operation. In this case, if a key indicator circuit 54 is connected to the melody tone latch circuit 25 to visually indicate keys to be operated on the keyboard 56 in response to the pitch data read out of the pitch data memory 20 then a player can operate keys while following the key indications. This feature is suitable particularly for the exercise by beginners.

Reference numerals 62, 63, 64 and 65 designate control switches for enabling or disabling chord/bass converter 52, musical tone forming circuit 53, key indicator 54, and rhythm tone generator 55, respectively.

In the above-mentioned embodiment, the subroutine data is provided for both the pitch data and the duration data. However, both of the pitch subroutine data and the duration subroutine data need not necessarily be provided. In an actual music performance, the repetitive pattern of duration more frequently appears than that of pitch. In some cases, depending on storage capacity of the memory portion of the musical sheet and the data memory the subroutine data may be provided for only one of pitch data and duration data. Namely, even if there is a repetitive pattern in the other of pitch data and duration data, the subroutine data need not be provided for the other of pitch data and duration data. It is evident that, when a repetitive pattern appears in the subroutine data, the sub-subroutine data corresponding to the repetitive pattern can be provided.

What we claim is:

1. An automatic performing apparatus comprising:

a first memory or storing note pitch data representing pitches of musical notes constituting progression of a music to be played;

musical tone forming circuit means coupled to said first memory or forming musical tone signals in response to note pitch data read out of said first memory;

a second memory for storing note duration data representing the durations of the musical notes, the note duration data having duration main routine data and duration subroutine data, the duration main routine data containing instruction data for calling the duration subroutine data, and the duration subroutine data containing instruction data for the return to the duration main routine data;

duration measuring circuit means coupled to said second memory for measuring a time length represented by note duration data read out of said second memory;

first readout control circuit means for sequentially reading the note pitch data of musical notes out of said first memory at time intervals corresponding to the durations of the musical notes in response to said duration measuring circuit means;

second readout control circuit means for sequentially reading the note duration data of musical notes out of said second memory at time intervals corresponding to the durations of the musical notes in response to said duration measuring circuit means; and subroutine control circuit means coupled to said second memory and responsive to the instruction data for calling the duration subroutine data read out during the readout of the main routine data from said second memory to cause said second readout control circuit means to read the duration subroutine data out of said second memory, and responsive to the instruction data for the return to the duration main routine data read out from said second memory to cause said second readout control circuit means to read said duration main routine data out of said second memory.

2. An automatic performing apparatus comprising:

a first memory for storing note pitch data representing pitches of musical notes constituting progression of a music to be played, the note pitch data having pitch main routine data and pitch subroutine data, the pitch main routine data containing instruction data for calling the pitch subroutine data, and the pitch subroutine data containing instruction data for the return to the pitch main routine data;

musical tone forming circuit means coupled to said first memory for forming musical tone signals in response to the note pitch data read out of said first memory;

a second memory for storing note duration data representing the durations of the musical notes;

duration measuring circuit means coupled to said second memory for measuring a time length represented by the note duration data read out of said second memory;

first readout control circuit means for sequentially reading note pitch data of musical notes out of said first memory at time intervals corresponding to the durations of the musical notes in response to said duration measuring circuit means;

second readout control circuit means for sequentially reading the duration data out of said second memory at time intervals corresponding to the durations of the musical notes in response to said duration measuring circuit means; and subroutine control circuit means coupled to said first memory and responsive to the instruction data for calling the pitch subroutine data read out during the readout of the pitch main routine data from said first memory to cause said first readout control circuit means to read the pitch subroutine data out of said first memory, and responsive to the instruction data for the return to the pitch main routine data read out of said first memory to cause said first readout control circuit means to read said pitch main routine data out of said first memory.

3. An automatic performing apparatus comprising:

a first memory or storing note pitch data representing pitches of musical notes constituting progression of a music to be played, the note pitch data having pitch main routine data and pitch subroutine data, said pitch main routine data containing instruction data for calling the pitch subroutine data, and said pitch subroutine data containing instruction data for the return to the pitch main routine data;

musical tone forming circuit means coupled to said first memory for forming musical tone signals in response to note pitch data read out of said first memory;

a second memory for storing note duration data representing the durations of the musical notes, the note duration data having duration main routine data and duration subroutine data, said duration main routine data containing instruction data for calling the duration subroutine data, and the duration subroutine data containing instruction data for the return to the duration main routine data;

duration measuring circuit means coupled to said second memory for measuring a time length represented by the note duration data read out of said second memory;

first read out control circuit means for sequentially reading note pitch data of musical notes out of said first memory at time intervals corresponding to the durations of the musical notes in response to said duration measuring circuit means;

second readout control circuit means for sequentially reading the note duration data out of said second memory at time intervals corresponding to the durations of the musical notes in response to said duration measuring circuit means;

first subroutine control circuit means coupled to said first memory and responsive to the instruction data for calling the pitch subroutine data read out during the readout of the pitch main routine data from said first memory to cause said first readout control circuit means to read the pitch subroutine data out of said first memory, and responsive to the instruction data for the return to the pitch main routine data read out of said first memory to cause said first readout control circuit means to read the pitch main routine data out said first memory; and second subroutine control circuit means coupled to said second memory and responsive to the instruction data for calling the duration subroutine data read out during the readout of the main routine data from said second memory to cause said second readout control circuit means to read the duration subroutine data out of said second memory, and responsive to the instruction data for the return to the duration main routine data read out of said second memory to cause said second readout control circuit means to read the duration main routine data out of said second memory.

4. An automatic performing apparatus according to claim 3, further comprising:

means for reading the pitch data and the duration data out of external storage means; and operation control circuit means coupled with start switch means and responsive to the operation of said start switch means to place said automatic performing apparatus in a data write mode in which the pitch data and the duration data read out of said external storage means are written into said first and second data memory, respectively, in a subroutine detecting mode in which, after the data is written into said first and second data memories, the pitch data and the duration data are read out of said first and second memories respectively, and said first and second subroutine control circuits detect and store the addresses of the pitch subroutine data and the duration subroutine data, and in a performance mode in which, following said subroutine detecting mode, said first and second readout control circuit means sequentially read the pitch data and the duration data out of said first and second memories at time intervals corresponding to the note durations in accordance with the progression of the music to be played.

5. An automatic performing apparatus according claim 4, wherein said first and second readout control circuit means each comprise an address counter for designating the addresses of the corresponding memory, and said subroutine control circuit comprises an adder circuit for adding 1 to a least significant bit of an output signal from said address counter, a latch circuit for latching an output signal of said adder circuit when the instruction data for calling the subroutine data is read out of the corresponding memory, an address converting memory for storing an output signal of said latch circuit in an address designated by the corresponding memory when the subroutine calling instruction data is read out in the subroutine detecting mode, a selector circuit which receives an output signal of said latch circuit and an output signal of said address converting memory to supply the output signal of said latch circuit as a preset signal to said address counter in a normal condition, and to supply the output signal of said address converting memory as the preset signal to said address counter when the instruction data for the return to the main routine data is read out of the corresponding data memory, and means for supplying a control signal to preset the preset signal in said address counter when the subroutine data calling instruction data or the instruction data for the return to the main routine data is read out of said memory in the performance mode.

* * * * *